US011084319B2

(12) United States Patent
Ganter et al.

(10) Patent No.: US 11,084,319 B2
(45) Date of Patent: Aug. 10, 2021

(54) METHOD FOR PRODUCING AN ORNAMENTAL DESIGN IN A CLEARCOAT LAYER

(71) Applicant: Dr. Ing. h.c. F. Porsche Aktiengesellschaft, Stuttgart (DE)

(72) Inventors: Matthias Ganter, Villingen-Schwenningen (DE); Martin Grammer, Marbach am Neckar (DE); Manuel Selinger, Wiernsheim (DE)

(73) Assignee: Dr. Ing. h.c. F. Porsche Aktiengesellschaft

( * ) Notice: Subject to any disclaimer, the term of this patent is extended or adjusted under 35 U.S.C. 154(b) by 15 days.

(21) Appl. No.: 16/686,278

(22) Filed: Nov. 18, 2019

(65) Prior Publication Data

US 2020/0156403 A1 May 21, 2020

(30) Foreign Application Priority Data

Nov. 16, 2018 (DE) ..... 10 2018 128 843.3

(51) Int. Cl.
*B05D 3/06* (2006.01)
*B44C 1/00* (2006.01)

(52) U.S. Cl.
CPC ..... *B44C 1/005* (2013.01); *B05D 3/06* (2013.01)

(58) Field of Classification Search
CPC ..... B44C 1/005
See application file for complete search history.

(56) References Cited

U.S. PATENT DOCUMENTS

| | | | | |
|---|---|---|---|---|
| 4,803,114 | A | 2/1989 | Schledorn | |
| 2005/0269301 | A1* | 12/2005 | Burrowes | C03C 23/0025 219/121.69 |
| 2012/0316280 | A1* | 12/2012 | Meyer | C08L 53/00 524/432 |

FOREIGN PATENT DOCUMENTS

| | | |
|---|---|---|
| DE | 10 2014 202 603 | 8/2015 |
| EP | 2 660 067 | 11/2013 |
| EP | 3 342 602 | 7/2018 |
| GB | 2470067 | 11/2010 |
| GB | 2567811 | 5/2019 |
| JP | 2011-126179 | 6/2011 |
| JP | 2012-110916 | 6/2012 |

(Continued)

OTHER PUBLICATIONS

Korean Office Action dated Oct. 5, 2020.
German Search Report dated Jul. 8, 2019.

*Primary Examiner* — Ian A Rummel
(74) *Attorney, Agent, or Firm* — Gerald E. Hespos; Michael J. Porco; Matthew T. Hespos

(57) ABSTRACT

A method is for producing an ornamental design (O) in a clearcoat layer (K). The ornamental design (O) is produced by a selective matting of the clearcoat layer (K) by working the clearcoat layer (K) by a laser. The working of the clearcoat layer may be performed by a UV laser. Additionally, the working of the clearcoat layer K may be performed by electromagnetic waves at a wavelength of about 355 nm. Furthermore, the working of the clearcoat layer K may be performed by a laser operating at a frequency of about 23 500 Hz. Still further, the working of the clearcoat layer (K) may be performed by a laser operating with a pulse duration of about 2 μs. The working of the clearcoat layer (K) may be performed by a laser operating with a line spacing of about 0.03 mm.

2 Claims, 1 Drawing Sheet

(56) References Cited

FOREIGN PATENT DOCUMENTS

| | | |
|---|---|---|
| JP | 2016-087618 | 5/2016 |
| KR | 10-2018-0055797 | 5/2018 |

* cited by examiner

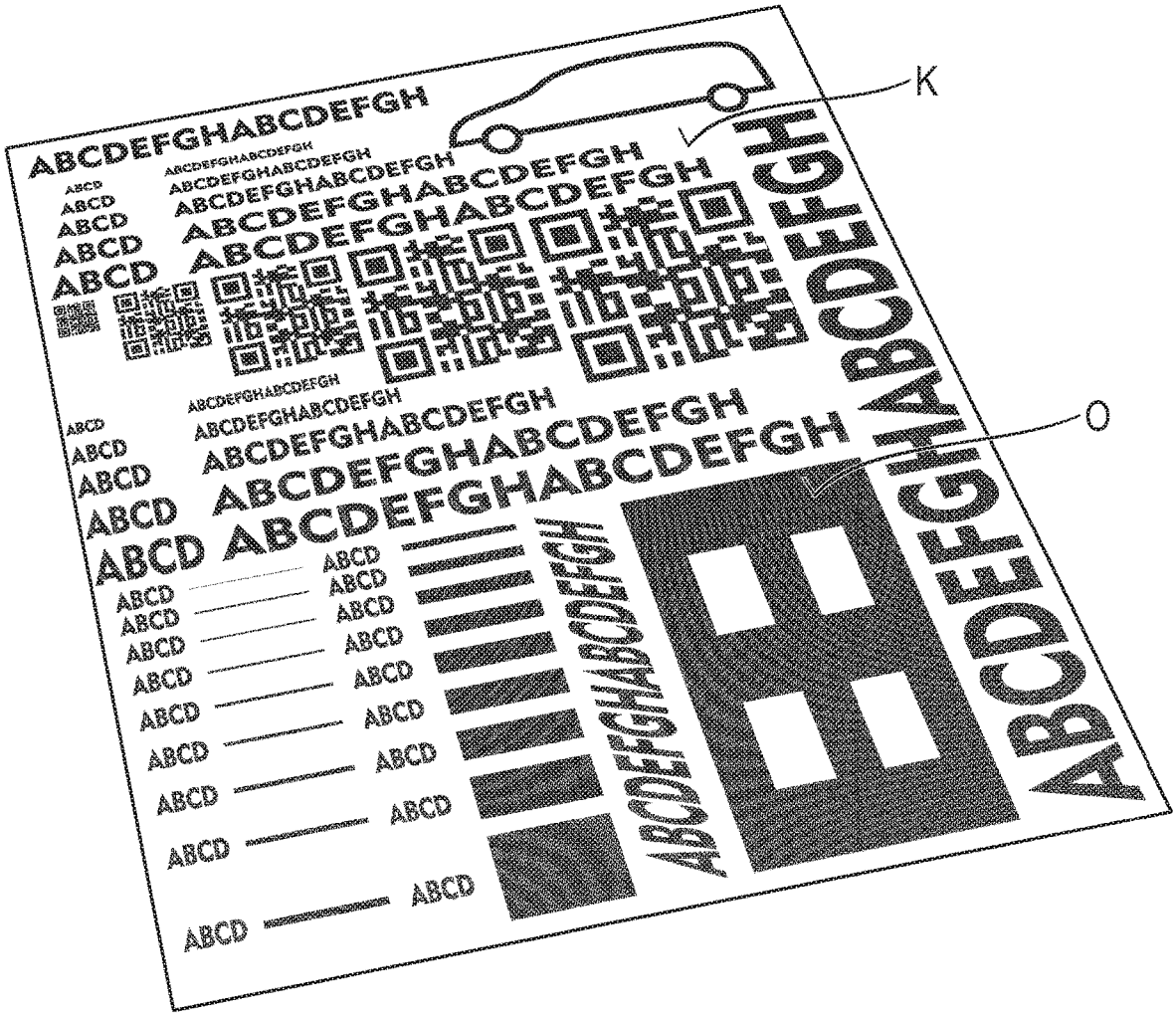
K
O
ABCDEFGHABCDEFGH
ABCD

METHOD FOR PRODUCING AN ORNAMENTAL DESIGN IN A CLEARCOAT LAYER

CROSS REFERENCE TO RELATED APPLICATION

This application claims priority under 35 USC 119 to German Patent Appl. No. 10 2018 128 843.3 filed on Nov. 16, 2018, the entire disclosure of which is incorporated herein by reference.

BACKGROUND

Field of the Invention

The invention relates to a method for producing an ornamental design in a clearcoat layer, to a component for a motor vehicle with a clearcoat layer and an ornamental design produced by such a method in the clearcoat layer and to a motor vehicle comprising such a component.

Related Art

DE 10 2014 202 603 A1 discloses a method for producing an ornamental design in a clearcoat layer. The ornamental design in this case is introduced into the clearcoat layer mechanically by a rotating removal element so that three-dimensional depressions are produced in the clearcoat layer.

An object of the invention is to provide a method for producing an ornamental design in a clearcoat layer that can be completed more quickly and with less preliminary work.

SUMMARY

The invention relates to a method of producing an ornamental design by a selective matting of the clearcoat layer by working the clearcoat layer with a laser.

The method of the invention allows a quicker working time to be achieved with no further preliminary work. Thus, a prior application of a film to the clearcoat layer is unnecessary.

The working of the clearcoat layer may be performed by a UV laser.

The working of the clearcoat layer may performed by electromagnetic waves with a wavelength of about 355 nm.

In one embodiment, the working of the clearcoat layer is performed by a laser operating at a frequency of about 23 500 Hz.

An embodiment of the method includes working the clearcoat layer by a laser operating with a pulse duration of about 2 μs.

The working of the clearcoat layer may be performed by a laser operating with a line spacing of about 0.03 mm.

The invention also relates to a component for a motor vehicle, in particular a body component for a motor vehicle, with a clearcoat layer and an ornamental design produced in the clearcoat layer by the method described herein.

The invention further relates to a motor vehicle with a clearcoat layer and an ornamental design produced in the clearcoat layer by the method described herein.

Details and further advantages of the method according to the invention for producing an ornamental design in a clearcoat layer are explained on the basis of the exemplary embodiment described below.

BRIEF DESCRIPTION OF THE DRAWINGS

FIG. 1 is a perspective view of a component having a clearcoat layer in which an ornamental design has been produced by the method of the invention.

DETAILED DESCRIPTION

The application relates to a method for producing an ornamental design O in a clearcoat layer K. The ornamental design O is produced by a selective matting of the clearcoat layer K by means of a working of the clearcoat layer K by a laser.

The method according to the application allows a quicker working time to be achieved. There is no further preliminary work. Thus, the prior application of a film to the clearcoat layer is unnecessary.

The working of the clearcoat layer K may be performed by a UV laser.

The working of the clearcoat layer K may be performed by electromagnetic waves at a wavelength of about 355 nm.

The working of the clearcoat layer K may be performed by a laser operating at a frequency of about 23 500 Hz.

The working of the clearcoat layer K may be performed by a laser operating with a pulse duration of about 2 μs.

The working of the clearcoat layer K may be performed by a laser operating with a line spacing of about 0.03 mm.

The application also relates to a component for a motor vehicle, in particular a body component for a motor vehicle, with a clearcoat layer K and an ornamental design O produced by the method described herein.

The working of the clearcoat layer K may be performed by a laser of the Trumpf brand, in particular by means of the TruMark 3330 model. In this case, the laser may be operated at a power output of 65% with respect to the maximum output.

The application also relates to a motor vehicle comprising a component as described herein.

What is claimed is:

1. A method for producing an ornamental design on a body component for a motor vehicle, comprising: applying a clearcoat layer on the body component; using a UV laser operating at a frequency of about 23 500 Hz with a pulse duration of about 2 μs for selective matting of the clearcoat layer by working the clearcoat layer with the laser operating with a line spacing of about 0.03 mm to produce the ornamental design in the clearcoat layer.

2. The method of claim 1, wherein the working of the clearcoat layer is performed by electromagnetic waves at a wavelength of about 355 nm.

* * * * *